US007313338B2

(12) United States Patent
Shimazu et al.

(10) Patent No.: US 7,313,338 B2
(45) Date of Patent: Dec. 25, 2007

(54) IMAGE TRANSFER DEVICE

(75) Inventors: Fumio Shimazu, Nara (JP); Toshiki Takiguchi, Yamatokoriyama (JP); Hiroyuki Murai, Gose (JP); Yoko Sawa, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 231 days.

(21) Appl. No.: 11/119,233

(22) Filed: Apr. 28, 2005

(65) Prior Publication Data

US 2005/0244594 A1 Nov. 3, 2005

(30) Foreign Application Priority Data

Apr. 30, 2004 (JP) ..... P2004-136500

(51) Int. Cl.
*G03G 15/16* (2006.01)
*G03G 15/08* (2006.01)
*G03G 15/20* (2006.01)

(52) U.S. Cl. ..... 399/66; 399/121; 399/310

(58) Field of Classification Search ..... 399/66, 399/121, 310, 313
See application file for complete search history.

(56) References Cited

U.S. PATENT DOCUMENTS 6,044,244 A * 3/2000 Watanabe et al. ..... 399/313
2004/0005175 A1* 1/2004 Lee ..... 399/313

FOREIGN PATENT DOCUMENTS

| | | | |
|---|---|---|---|
| JP | 03-225384 | | 10/1991 |
| JP | 03225384 A | * | 10/1991 |
| JP | 05-011625 | | 1/1993 |
| JP | 09-006145 | | 1/1997 |

* cited by examiner

*Primary Examiner*—David M. Gray
*Assistant Examiner*—Joseph S. Wong
(74) *Attorney, Agent, or Firm*—David G. Conlin; David A. Tucker; Edwards Angell Palmer & Dodge LLP

(57) ABSTRACT

An image transfer device includes an image transfer electrode roller which is disposed face to face with a photosensitive drum with a printing sheet passing between the image transfer electrode roller and the photosensitive drum. The image transfer device is structured such that the image transfer electrode roller can be shifted back and forth along a transport direction of the printing sheet. A voltage is applied to the image transfer electrode roller to create an image transfer electric field between the image transfer electrode roller and the photosensitive drum for transferring a toner image formed on the photosensitive drum onto the printing sheet. The image transfer electrode roller is brought to one of different positions along a transport direction of the printing sheet selected according to information on properties of the printing sheet and transfers the toner image onto the printing sheet at that position.

13 Claims, 8 Drawing Sheets

IMAGE TRANSFER DEVICE

CROSS REFERENCE

This Nonprovisional application claims priority under 35 U.S.C. § 119(a) on patent application Ser. No. 2004-136500 filed in Japan on Apr. 30, 2004, the entire contents of which are hereby incorporated by reference.

BACKGROUND OF THE INVENTION

The present invention relates generally to an image transfer device including image transfer members for transferring an image from an image receiving member onto a recording medium and, more particularly, to an image transfer device for transferring an image onto a recording medium with the aid of an electric field applied by an endless belt having a specific value of electrical resistance.

There exists a conventionally known electrophotographic image forming apparatus provided with an image transfer device which includes image transfer members and an endless belt, in which the image transfer members are located to face an image receiving member via the endless belt, the image receiving member carrying an image visualized by a developer. With a specific voltage applied, the image transfer members create an image transfer electric field. A recording medium onto which the image is to be transferred is fed onto a primary side of the endless belt facing the image receiving member and transported between the image receiving member and the image transfer members as the endless belt turns with the recording medium adhering to the primary side of the endless belt. The visual image on the image receiving member is transferred onto the recording medium by the electric field applied by the endless belt through the recording medium.

In the image transfer device thus structured, the intensity of the electric field applied at an image transfer position varies with such properties of the recording medium as the thickness and water content thereof. With this arrangement, the voltage applied to the image transfer members is controllably varied according to the properties of the recording medium in some conventional image transfer devices as disclosed on Japanese Laid-Open Patent Application Nos. H03-225384 and H05-11625.

To control the applied voltage according to the properties of the recording medium in this manner, however, there is the need for the provision of a power supply capable of varying the supply voltage over a wide range from a low voltage to a high voltage. One conventional approach to varying the supply voltage of a single power supply over a wide range from a low voltage to a high voltage in this fashion is to ground the image transfer members via a variable resistor. This approach, however, has such problems as an increase in size and manufacturing cost of the image transfer device due to the need for a wide variable range of the variable resistor, as well as a risk of excessive heat generation as a result of a change in the supply voltage.

SUMMARY OF THE INVENTION

It is an object of the invention to provide an image transfer device which allows for a reduction in physical size and manufacturing cost and an improvement in safety by making it possible to supply a constant level of voltage to image transfer members and transfer an image onto a recording medium regardless of changes in properties of the recording medium.

An image transfer member (image transfer electrode roller) of an image transfer device of the invention can be shifted along a transport direction of a recording medium according to properties of the recording medium. The distance between an image transfer position where an image is transferred onto the recording medium and the image transfer electrode roller varies when the image transfer electrode roller is displaced along the transport direction of the recording medium. The intensity of an image transfer electric field applied at the image transfer position varies with a change in the distance between the image transfer position and the image transfer electrode roller. Thus, it is possible to transfer the image onto the recording medium at an appropriate electric field intensity with the image transfer electrode roller located at a position suited to the properties of the recording medium.

Consequently, the image transfer device of the invention makes it possible to form a high-quality image on the recording medium. According to the invention, it is only needed to supply a constant level of voltage to the image transfer electrode roller, and it is not necessary to increase or decrease the level of voltage supplied to the image transfer electrode roller according to the properties of the recording medium. Accordingly, there is no need for the provision of any dedicated device for varying the level of voltage supplied. This makes it possible to reduce the physical size and manufacturing cost of the image transfer device. The invention also makes it possible to reduce a load of a voltage supply control system. Furthermore, as the invention serves to protect an image receiving member (photosensitive drum) from potentially occurring overcurrent and overvoltage, it is possible to provide improved operational safety.

These and other objects, features and advantages of the invention will become more apparent upon reading the following detailed description along with the accompanying drawings.

BRIEF DESCRIPTION OF THE DRAWINGS

FIGS. 3A, 3B and 3C are diagrams showing how the image transfer device is shifted according to properties of individual printing sheets, in which FIG. 3A shows a position where the image transfer device is located when the printing sheet is a thick sheet of paper or when the result of detection obtained by an ambient condition sensor is high temperature or high humidity, FIG. 3B shows a position where the image transfer device is located when the printing sheet is an ordinary sheet of paper or when the result of detection obtained by the ambient condition sensor is normal temperature or normal humidity, and FIG. 3C shows a position where the image transfer device is located when the printing sheet is low temperature or low humidity;

FIGS. 8A, 8B and 8C are diagrams showing how an image transfer device according to a second embodiment of the invention is shifted according to properties of individual printing sheets, in which FIG. 8A shows a position where the image transfer device is located when the printing sheet is a thick sheet of paper or when the result of detection obtained by an ambient condition sensor is high temperature or high humidity, FIG. 8B shows a position where the image transfer device is located when the printing sheet is an ordinary sheet of paper or when the result of detection obtained by the ambient condition sensor is normal temperature or normal humidity, and FIG. 8C shows a position where the image transfer device is located when the printing sheet is low temperature or low humidity.

DETAILED DESCRIPTION OF THE PREFERRED EMBODIMENTS OF THE INVENTION

Specific embodiments of the present invention are now described in detail with reference to the accompanying drawings.

Figure 1:
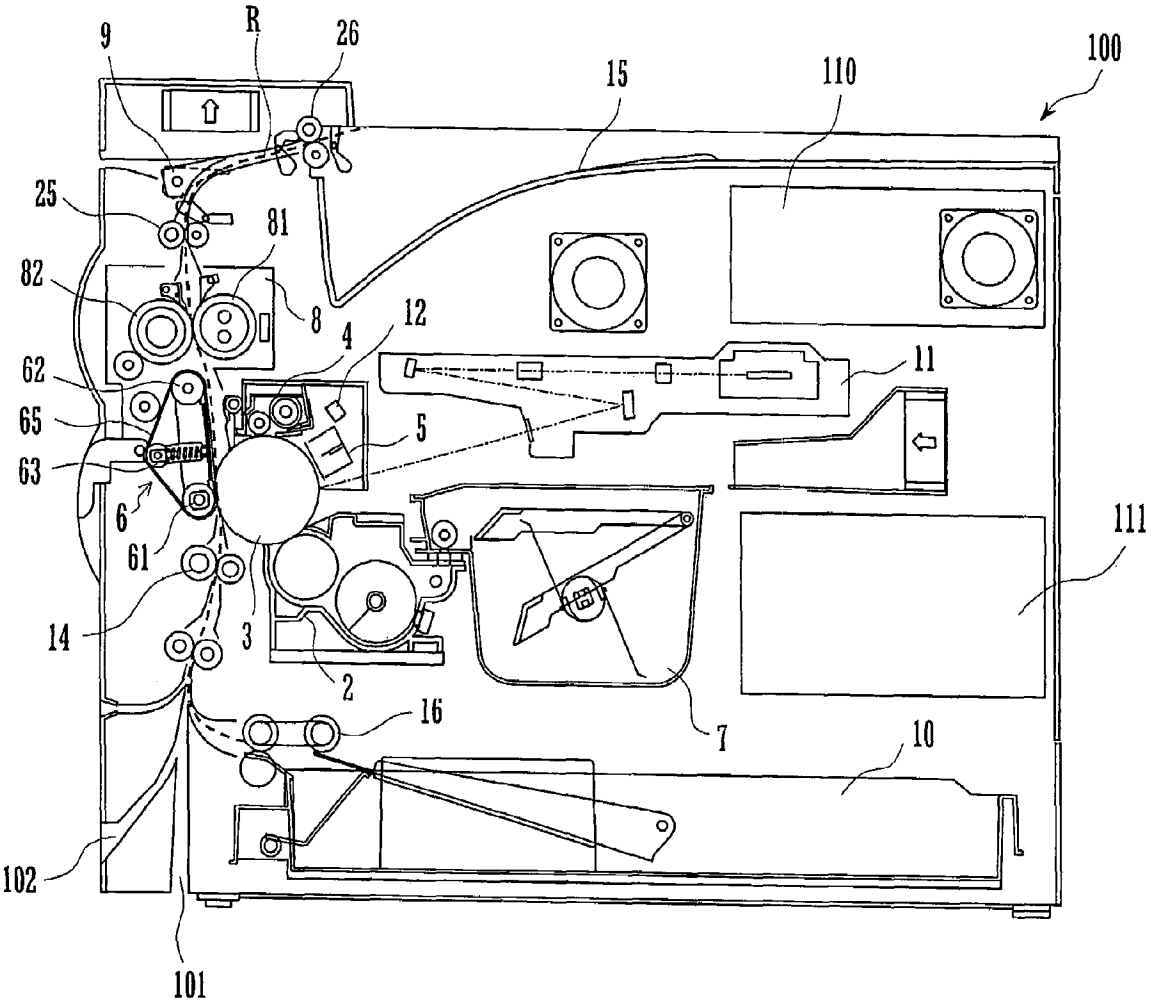
FIG. 1 is a cross-sectional diagram generally showing the structure of an image forming apparatus provided with an image transfer device according to a preferred embodiment of the invention.

FIG. 1 is a cross-sectional diagram generally showing the structure of an image forming apparatus 100 provided with an image transfer device 6 according to a first embodiment of the invention. The image forming apparatus 100 provided with the image transfer device 6 of the embodiment has a paper cassette 10 located at a bottom portion of the image forming apparatus 100 in which sheets of a recording medium, such as printing paper, are accommodated. The image forming apparatus 100 forms an image on each sheet of paper by transferring and fusing a toner image thereto.

The image forming apparatus 100 has at an upper part thereof a delivery tray 15. Each sheet on which an image has been formed is discharged onto the delivery tray 15. There is provided a vertically running sheet transport path R between the paper cassette 10 and the delivery tray 15. Individual sheets of paper accommodated in the paper cassette 10 are pulled out one by one and fed into the sheet transport path R by a pickup roller 16 which is disposed close to the paper cassette 10.

The image forming apparatus 100 includes a photosensitive drum 3 provided in the proximity of the sheet transport path R as illustrated. The photosensitive drum 3 corresponds to an image receiving member referred to in the appended claims of this invention. The image forming apparatus 100 further includes a charger unit 5, an optical scanning unit 11, a developer unit 2, a cleaner unit 4 and a discharging lamp 12 in addition to the aforementioned image transfer device 6.

The charger unit 5 uniformly charges a cylindrical outer surface of the photosensitive drum 3. The optical scanning unit 11 scans an original image and writes a corresponding optical image (electrostatic latent image) on the outer surface of the uniformly charged photosensitive drum 3. The developer unit 2 supplies toner held from a developer container 7 onto the surface of the photosensitive drum 3 to form a visible toner image. The image transfer device 6 transfers the toner image formed on the photosensitive drum 3 onto a sheet of paper. The cleaner unit 4 removes toner powder left unused on the surface of the photosensitive drum 3 for recycling the same in future image forming operation. The discharging lamp 12 removes residual static charge left on the surface of the photosensitive drum 3. The image transfer device 6 will be later described in detail.

A pair of registration rollers 14 is disposed in the sheet transport path R upstream of the photosensitive drum 3 along a sheet transport direction. The registration rollers 14 adjust timing with which the sheet of paper is supplied to an image transfer position T (sheet nipping position) located between the photosensitive drum 3 and an image transfer electrode roller 61. The image transfer electrode roller 61 corresponds to the image transfer member of the invention.

The image forming apparatus 100 is provided with such peripheral units as an external sheet feed unit (not shown) including a multi-stage sheet tray and a large-capacity sheet feed unit for storing a large quantity of sheets beneath the image forming apparatus 100. In the image forming apparatus 100, there are formed close to the paper cassette 10 a sheet inlet 101 through which each sheet fed from the external sheet feed unit is guided toward the image transfer position T and an extended sheet inlet 102 each sheet fed from the large-capacity sheet feed unit is guided toward the image transfer position T.

A fuser unit 8 including a fuser roller 81 and a pressure roller 82 located face to face on both sides of the sheet transport path R is disposed downstream of the photosensitive drum 3 along the sheet transport direction. The sheet of paper on which the toner image has been transferred is guided into the fuser unit 8 and passed between the fuser roller 81 and the pressure roller 82 which together apply heat and pressure onto the sheet, whereby the loose toner image is fused and fixed onto the sheet.

A pair of transport rollers 25 and a path switching gate 9 are disposed downstream of the fuser roller 81 along the sheet transport direction. The transport rollers 25 feed the sheet which has passed through the fuser unit 8 further downstream along the sheet transport path R, and the path switching gate 9 selectively determines a path through which the sheet is to be passed.

The image forming apparatus 100 includes a control unit 110 located above the optical scanning unit 11. Although not illustrated, the control unit 110 includes a circuit board for performing image forming operation and an interface board through which image data can be input from an external device. The image forming apparatus 100 also includes a power supply unit 111 located beneath the optical scanning unit 11. The power supply unit 111 supplies electricity to individual parts of the image forming apparatus 100. For example, the power supply unit 111 supplies a constant voltage to the image transfer electrode roller 61.

Figure 2:
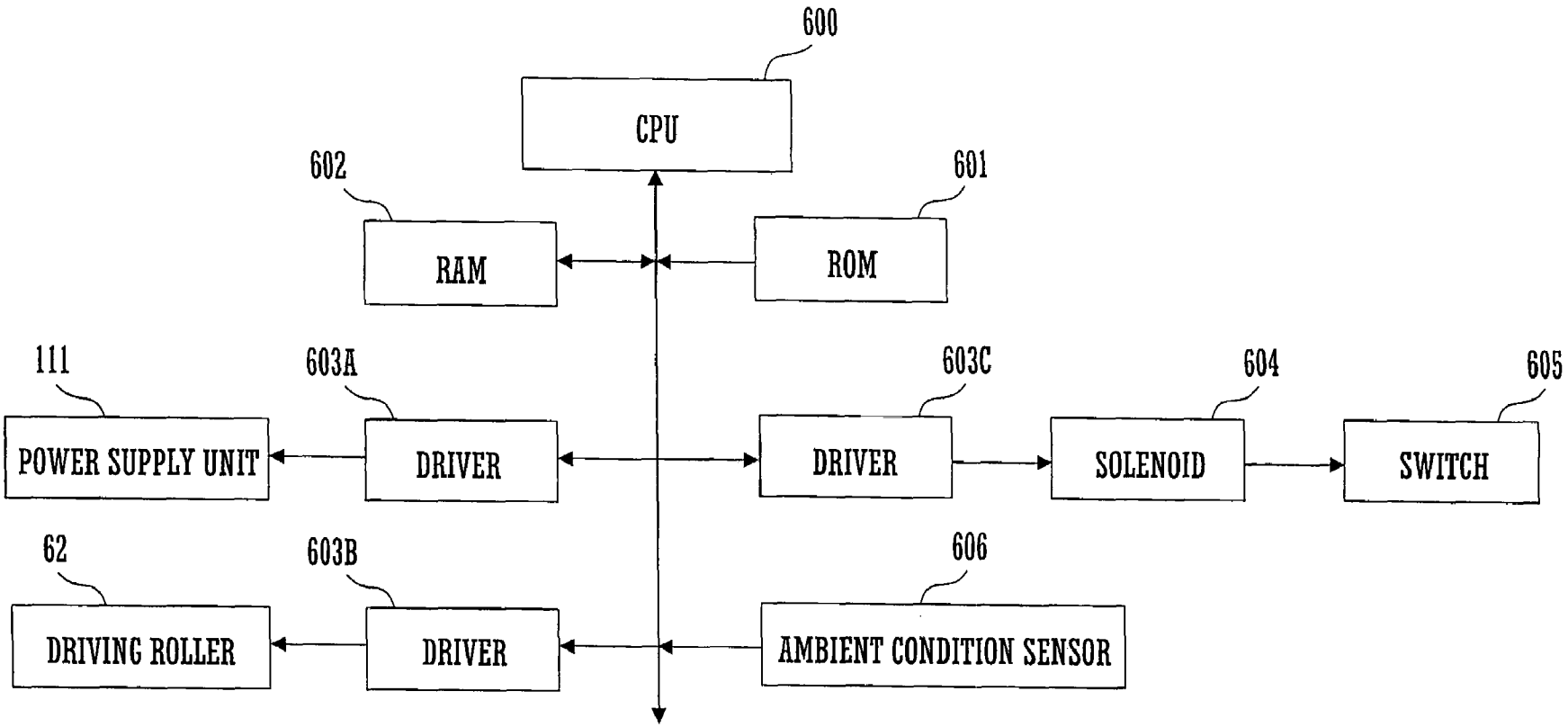
FIG. 2 is a block diagram showing the configuration of part of a control unit of the image forming apparatus of FIG. 1.

FIG. 2 is a block diagram showing the configuration of part of the control unit 110 of the image forming apparatus 100. The control unit 110 includes a central processing unit (CPU) 600 to which a read-only memory (ROM) 601 storing a program for controlling operation of the image transfer device 6, for instance, a random access memory (RAM) 602 which is a volatile memory serving as a work area of the CPU 600, drivers 603A, 603B, 603C for driving various devices and an ambient condition sensor 606 are connected. The CPU 600 performs overall control of these devices.

The driver 603A drives the power supply unit 111, the driver 603B drives a driving roller 62 of the image transfer device 6, and the driver 603C actuates a solenoid 604. The solenoid 604 switches a switch 605 between ON and OFF states to connect or disconnect a voltage applied by the power supply unit 111 to the image transfer electrode roller 61. The ambient condition sensor 606 detects ambient conditions of the photosensitive drum 3 including temperature and humidity in the vicinity thereof. As an alternative to the aforementioned arrangement of the embodiment of the invention, the image transfer device 6 may be provided with a dedicated control device for controlling the operation thereof.

Figure 3A:
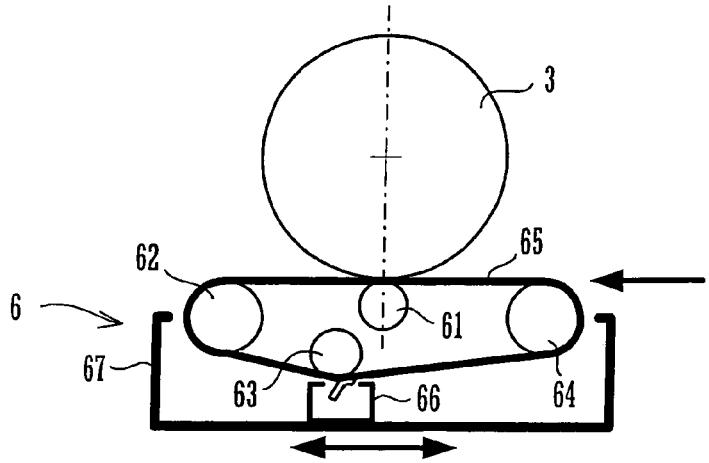
Figure 3B:
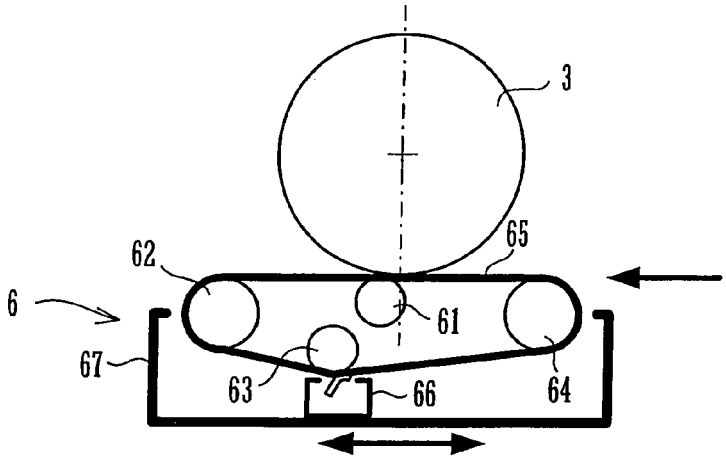
Figure 3C:
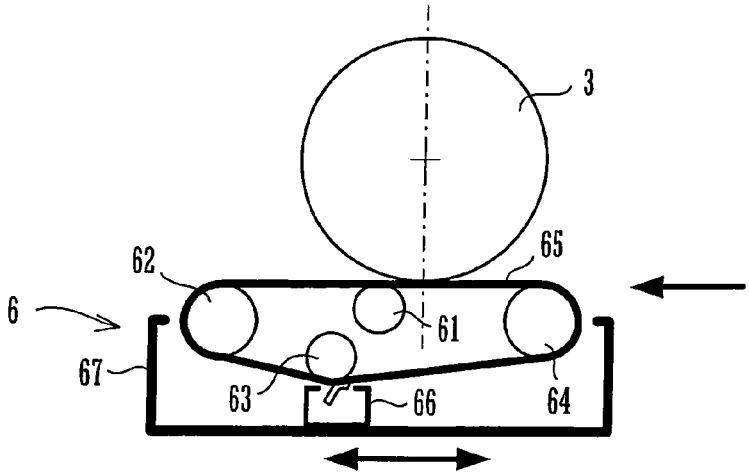

FIGS. 3A, 3B and 3C are diagrams showing how the image transfer device 6 is shifted according to properties of individual sheets of paper, or printing sheets. Specifically, FIG. 3A shows a position P1 where the image transfer electrode roller 61 of the image transfer device 6 is located when the printing sheet in use is a thick sheet of paper or when the result of detection obtained by the ambient condition sensor 606 is high temperature or high humidity, FIG. 3B shows a position P2 where the image transfer electrode roller 61 of the image transfer device 6 is located when the printing sheet in use is an ordinary sheet of paper or when the result of detection obtained by the ambient condition sensor 606 is normal temperature or normal humidity, and FIG. 3C shows a position P3 where the image transfer electrode roller 61 of the image transfer device 6 is located when the printing sheet in use is a thin sheet of paper or when the result of detection obtained by the ambient condition sensor 606 is low temperature or low humidity. As illustrated in FIGS. 3A, 3B and 3C, the photosensitive drum 3 turns clockwise and the sheet is conveyed from right to left.

The image transfer device 6 includes, in addition to the aforementioned image transfer electrode roller 61 and driving roller 62, a tension roller 63, an auxiliary roller 64, an image transfer belt 65, a cleaning unit 66 and a frame 67 accommodating these components 61-66. As shown in FIGS. 3A, 3B and 3C, the image transfer device 6 is structured such that the image transfer electrode roller 61 and the photosensitive drum 3 are disposed face to face with each other with the image transfer belt 65 passing therebetween and the printing sheet passes immediately along a primary side of the image transfer belt 65 facing the photosensitive drum 3. The printing sheet fed onto the image transfer belt 65 is electrostatically attracted by the primary side thereof and advanced as the image transfer belt 65 turns.

The image transfer electrode roller 61 includes a spindle made of a stainless or other iron-based rod and a layer of electrically conductive foam material surrounding the spindle. The foam material layer is made of urethane rubber or ethylene-propylene-diene terpolymer (EPDM), for example, and has a volume resistivity of approximately $1*10^{7}$ Ω·cm. Also, the foam material layer has a hardness of 60 to 75 as measured by the Japanese Industrial Standard Asker C hardness scale (JIS-C). The image transfer electrode roller 61 is has an outside diameter of approximately 18 mm.

The image transfer electrode roller 61 is connected to the power supply unit 111 via a compression spring and electrically conductive bearings. During image transfer operation for transferring the toner image from the outer surface of the photosensitive drum 3 onto the printing sheet, the power supply unit 111 applies an image transfer bias to the image transfer electrode roller 61, the polarity of the image transfer bias being opposite to that applied to the toner powder. In this embodiment, the toner is negatively charged so that a positive image transfer bias is applied to the image transfer electrode roller 61. During belt cleaning operation for removing residual toner powder adhering to the image transfer belt 65 upon completion of the image transfer operation, the power supply unit 111 applies a cleaning bias to the image transfer electrode roller 61, the polarity of the cleaning bias being the same as that applied to the toner powder.

Located downstream of the image transfer electrode roller 61 along the sheet transport direction, the driving roller 62 is driven to turn counterclockwise as illustrated in FIGS. 3A, 3B, 3C by rotational drive means (not shown). Like the image transfer electrode roller 61, the driving roller 62 includes a spindle made of a stainless or other iron-based rod and a layer of electrically conductive foam material surrounding the spindle.

The tension roller 63 is a metallic roller which applies a specific force against the image transfer belt 65 in a direction oriented away from the sheet transport path R. The tension roller 63 used in this embodiment is produced by machining a stainless steel rod member. If there is more space to accommodate the image transfer device 6 having a larger size, the tension roller 63 may be formed into a larger outside diameter by using an aluminum-based material.

The image transfer belt 65 is an endless belt formed by extrusion molding or centrifugal molding, for instance, by using urethane or acrylonitrile-butadiene rubber (NBR) as a main material. The image transfer belt 65 is electrically conductive and measures approximately 0.5 to 0.65 mm in thickness, with an outer surface of the image transfer belt 65 fluoroplastic-coated. The image transfer belt 65 has a volume resistivity within a range of $1*10^{8}$ to $1*10^{13}$ Ω·cm.

The image transfer device 6 structured as described above can be moved along the sheet transport direction. When the printing sheet onto which the toner image is to be transferred is a thick sheet of paper, the image transfer device 6 is located at the position P1 where the image transfer electrode roller 61 is closest to the photosensitive drum 3, that is, where central axes of the photosensitive drum 3 and the image transfer electrode roller 61 and the image transfer position T are located in line as illustrated in FIG. 3A. The position P1 shown in FIG. 3A where the image transfer electrode roller 61 is closest to the photosensitive drum 3 is also used as a home position where the image transfer device 6 is kept in a standby state when the image transfer operation is not in progress.

When the printing sheet is an ordinary sheet of paper, the image transfer device 6 performs the image transfer operation at the position P2 shown in FIG. 3B located downstream of the position P1 shown in FIG. 3A along the sheet transport direction. Also, when the printing sheet is a thin sheet of paper, the image transfer device 6 performs the image transfer operation at the position P3 shown in FIG. 3C located further downstream of the position P2 shown in FIG. 3B. The location of the image transfer device 6 is controlled such that the thinner the printing sheet, the more downstream the image transfer device 6 is located when performing the image transfer operation as discussed above. In the present embodiment, the electric resistance of the image transfer belt 65 is determined such that the position P3 where the image transfer device 6 is located when the printing sheet is a thin sheet of paper is at a distance of about 3 to 5 mm from the position P1 where the image transfer device 6 is located when the printing sheet is an ordinary sheet of paper. Although the image transfer device 6 is shifted to three different positions according to the thickness of the printing sheet in this embodiment, the number of positions of the image transfer device 6 is not limited to three. The aforementioned arrangement of the embodiment may be modified such that the image transfer device 6 can be shifted to more than three discrete positions or shifted continuously according to the thickness of the printing sheet. In this embodiment, the thickness of the printing sheet is determined in accordance with print conditions entered by an operator with a print request. The embodiment may also be modified to include a sensor for detecting the thickness of the printing sheet in use so that the image transfer device 6 can be automatically positioned based on the result of thickness detection.

Figure 4:
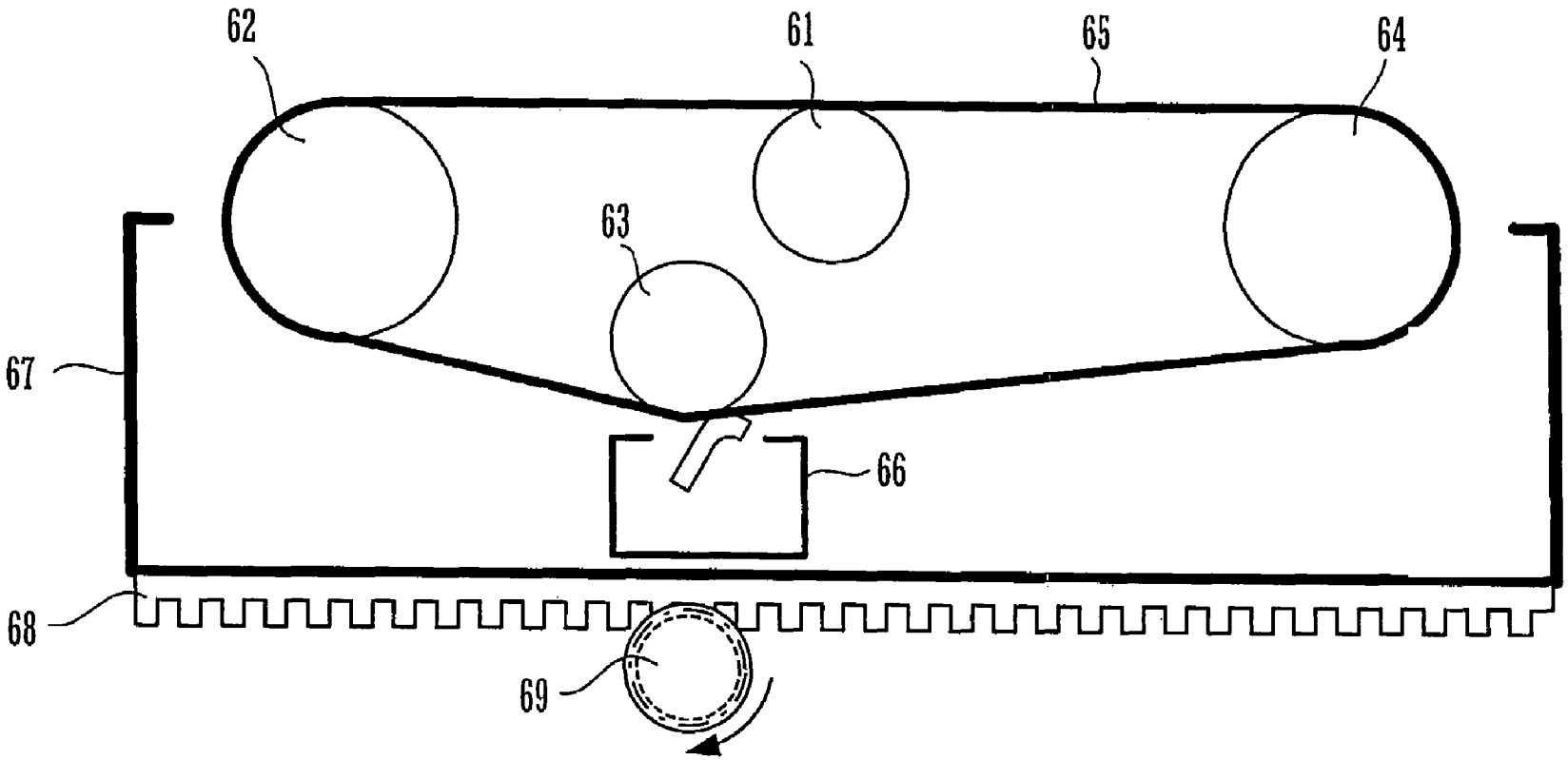
FIG. 4 is a diagram showing an image transfer device shift mechanism.

The image transfer device 6 further includes a rack 68 located beneath the frame 67 and a pinion gear 69 which meshes with the rack 68 as shown in FIG. 4. The pinion gear 69 exerts a rotational driving force on the rack 68 to shift the image transfer device 6 along the sheet transport direction according to the properties of individual printing sheets.

According to the embodiment, the control unit 110 may be control the image transfer device 6 to perform the image transfer operation at different positions according to the temperature or humidity in the vicinity of the image transfer position detected by the ambient condition sensor 606 instead of the thickness of the printing sheet. The control unit 110 acquires information on the temperature or humidity which is related to the water content of the printing sheet from the ambient condition sensor 606. As an example, the image transfer device 6 performs the image transfer position at the position P1 shown in FIG. 3A when the temperature detected by the ambient condition sensor 606 is high, and the position where the image transfer position is performed is shifted downstream along the sheet transport direction as the detected temperature decreases. Alternatively, the image transfer device 6 performs the image transfer position at the position P1 shown in FIG. 3A when the humidity detected by the ambient condition sensor 606 is high, and the position where the image transfer position is performed is shifted downstream along the sheet transport direction as the detected humidity decreases. The ambient condition sensor 606 detects the temperature or humidity near the image transfer position when the operator enters a print request, for instance, and the control unit 110 determines the position where the image transfer device 6 must be located based on accurate information about ambient conditions under which the image transfer operation is executed.

In another alternative, the control unit 110 may first determine the position where the image transfer device 6 should be located for performing the image transfer operation according to the thickness of the printing sheet and then fine-adjust the image transfer position according to the temperature or humidity detected by the ambient condition sensor 606.

Figure 5:
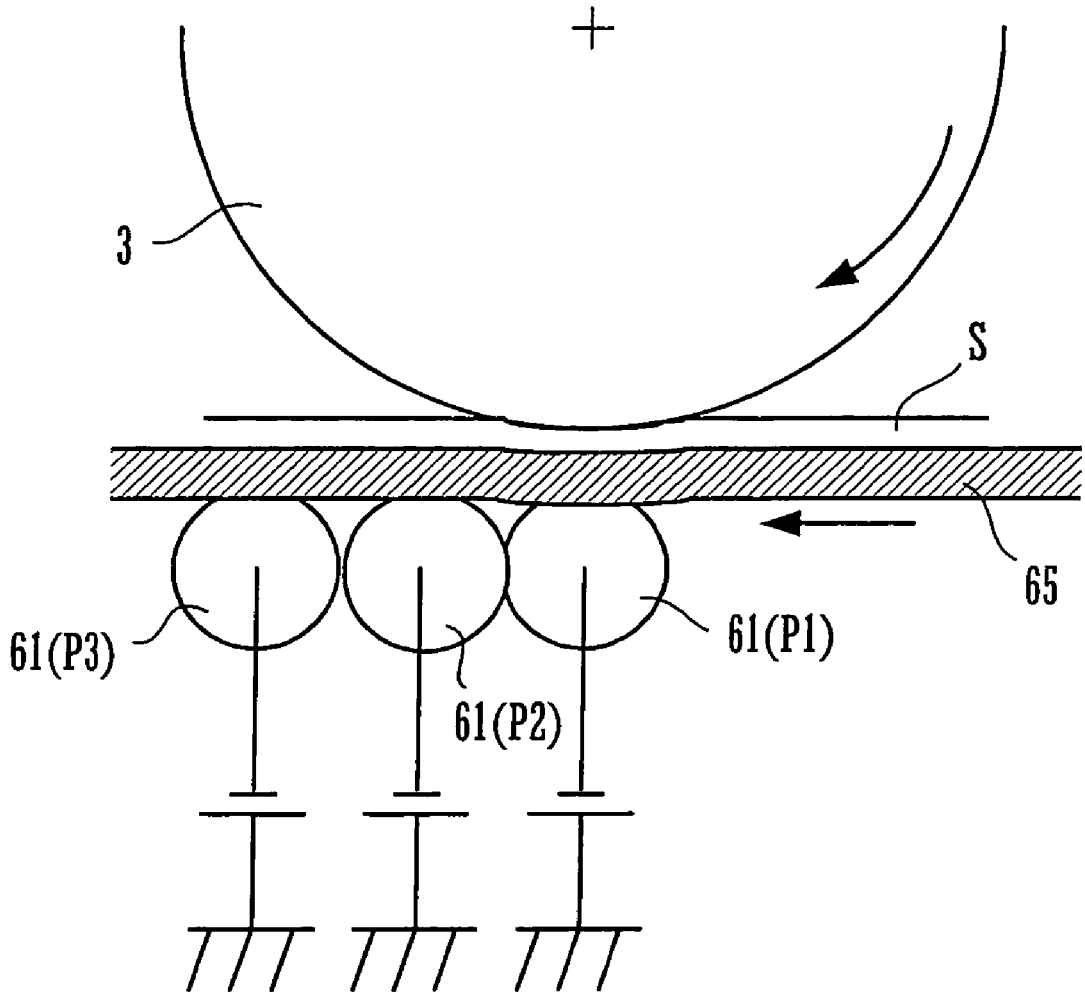
FIG. 5 is a diagram showing how a voltage applied to image transfer electrode roller varies.
Figure 6:
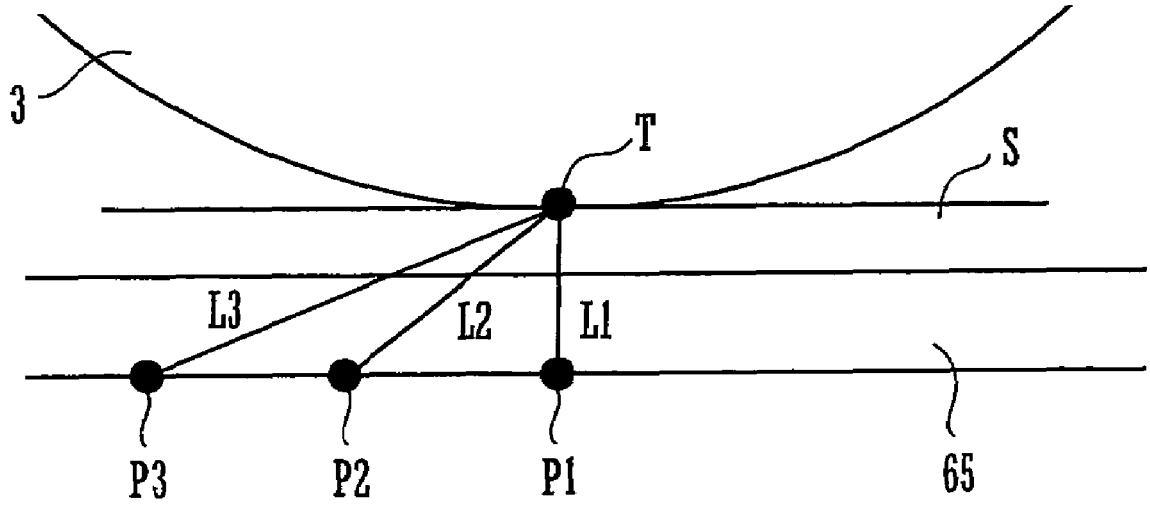
FIG. 6 is a diagram showing a relationship between the position of the image transfer electrode roller and the intensity of an image transfer electric field formed at an image transfer position.

FIG. 5 is a diagram showing how the voltage applied to the image transfer electrode roller 61 varies. FIG. 6 is a diagram showing a relationship between the position of the image transfer electrode roller 61 and the intensity of an image transfer electric field formed at the image transfer position. The image transfer device 6 performs the image transfer operation at one of the different positions P1, P2, P3 according to various properties of the printing sheet, such as the thickness or water content thereof, as discussed above. In the image transfer device 6 of the present embodiment, the same voltage is applied to the image transfer electrode roller 61 during the image transfer operation regardless of the position of the image transfer device 6.

If the voltage applied to the image transfer electrode roller 61 is constant, the image transfer electric field created by the image transfer electrode roller 61 decreases with distances L1, L2, L3 between the individual positions P1, P2, P3 and the image transfer position T, respectively. Since the image transfer belt 65 exists between the image transfer electrode roller 61 and the image transfer position T in this embodiment, the distance over which the electric field created by the image transfer electrode roller 61 extends through the image transfer belt 65 to the image transfer position T increases as the image transfer device 6 is located more downstream along the transport direction of a sheet S. Therefore, the electric field is attenuated by a greater degree as the image transfer device 6 is located more downstream along the sheet transport direction. There exists the sheet S between the image transfer belt 65 and the image transfer position T, so that the electric field is also attenuated by the sheet S. The thicker the sheet S, the greater the amount of this attenuation of the electric field. The thinner the sheet S, the smaller the amount of attenuation of the electric field.

Thus, the control unit 110 controls the image transfer device 6 such that the same is positioned where the image transfer electrode roller 61 is located at the position P1 closest to the image transfer position T and the image transfer device 6 is shifted downstream along the sheet transport direction as the thickness of the sheet S decreases. Since the image transfer operation is performed with the image transfer device 6 set at a location thus determined, it is possible to apply the electric field of an intensity suited to the thickness of the sheet S at the image transfer position T without varying the voltage applied to the image transfer electrode roller 61.

The aforementioned arrangement of the embodiment confers the same advantageous effect when the image transfer operation is performed by shifting the location of the image transfer device 6 according to the temperature or humidity detected by the ambient condition sensor 606 as well. If the temperature or humidity detected by the ambient condition sensor 606 is high, it is assumed that the sheet S has a large water content. If the temperature or humidity detected by the ambient condition sensor 606 is low, on the contrary, it is assumed that the sheet S has a low water content. When the water content of the sheet S is high, the electric resistance of the sheet S is high, and when the water content of the sheet S is low, the electric resistance of the sheet S is low. Thus, the control unit 110 controls the image transfer device 6 such that the same is shifted downstream along the sheet transport direction as the detected temperature or humidity which is related to the water content of the sheet S decreases. Since the image transfer operation is performed with the image transfer device 6 set at a location thus determined, it is possible to apply the electric field of an intensity suited to the thickness of the sheet S at the image transfer position T without varying the voltage applied to the image transfer electrode roller 61.

The image transfer belt 65 has a volume resistivity of $1*10^8$ to $1*10^{13}$ Ω·cm as previously mentioned. On the other hand, the sheet S has, depending on the thickness thereof, a volume resistivity within a range of $1*10^6$ to $1*10^{14}$ Ω·cm. The volume resistivity of the sheet S varies with changes in ambient temperature or humidity by $1*10^2$ to $1*10^{14}$ Ω·cm.

The electric resistance of the sheet S varies with the thickness thereof over a far wider range than with the ambient temperature or humidity as mentioned above. It is therefore possible to precisely determine the location of the image transfer device 6 in an efficient manner by first determining the position where the image transfer device 6 according to the thickness of the sheet S and then fine-adjust the location of the image transfer device 6 according to the ambient temperature or humidity.

As so far discussed, the image transfer device 6 performs the image transfer operation under conditions in which the image transfer electrode roller 61 is located in an area including the position P1 where the image transfer electrode roller 61 is closest to the photosensitive drum 3 along the sheet transport direction and positions located downstream of the position P1. When the image transfer electrode roller 61 is located downstream of the image transfer position T in this arrangement, it is possible to peel the sheet S off the photosensitive drum 3 while preventing the sheet S from getting entangled around the photosensitive drum 3 after the sheet S is passed through the image transfer electric field. In other words, it is possible to improve the performance of the image transfer device 6 to peel the sheet S off the photosensitive drum 3 by performing the image transfer operation under conditions where the image transfer electrode roller 61 is located downstream of the image transfer position T. The improved sheet peel-off performance is particularly advantageous when the sheet S is a less stiff thin sheet of paper.

Figure 7:
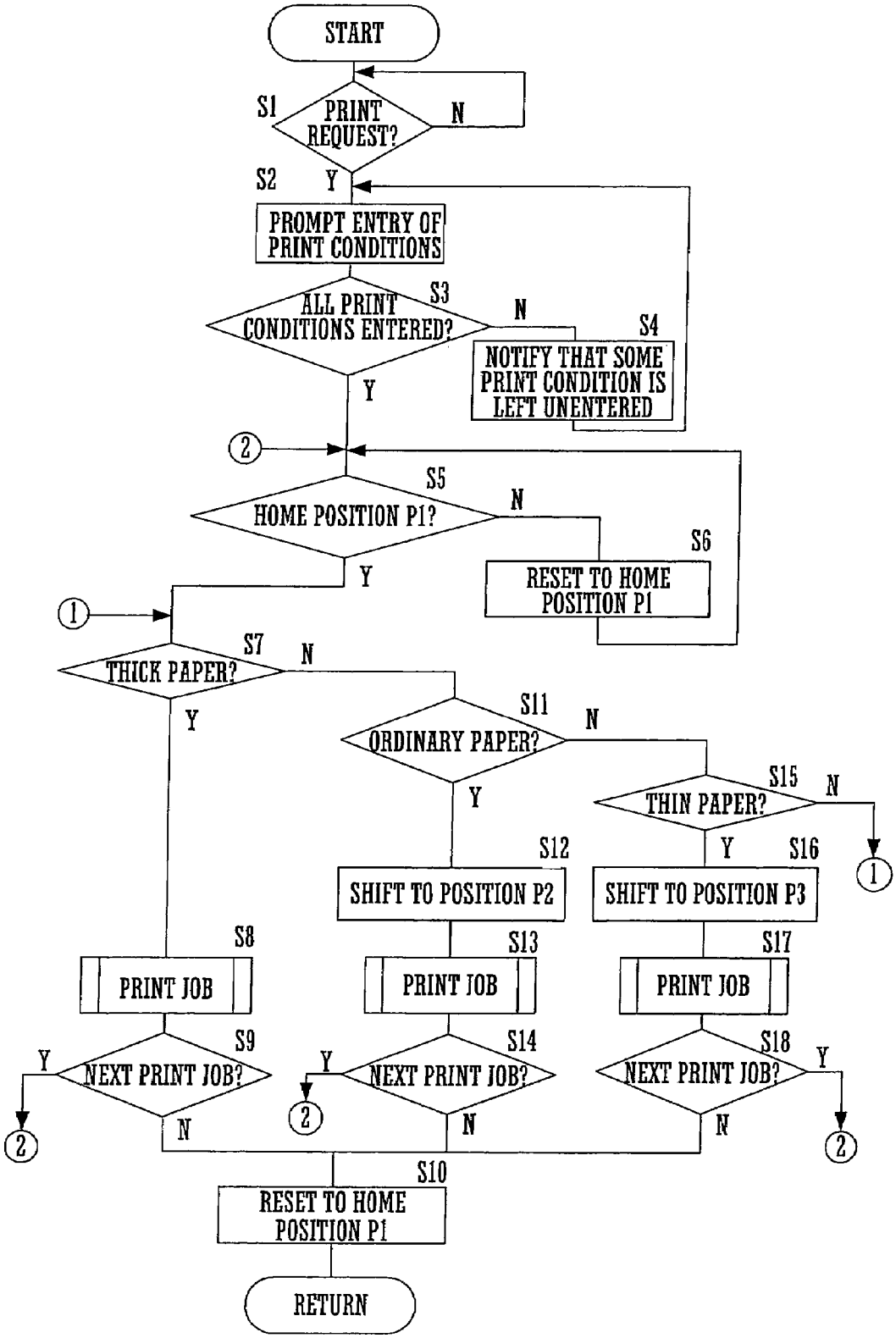
FIG. 7 is a flowchart showing part of an operating procedure performed by the control unit of the image forming apparatus.

FIG. 7 is a flowchart showing part of an operating procedure performed by the control unit 110. First, the CPU 600 of the control unit 110 judges whether a print request has been entered by the operator (step S1). If it is judged that no print request has been entered yet, the CPU 600 repetitively makes the judgment of step S1 until the print request is entered. When the CPU 600 judges that the print request has been entered in step S1, the CPU 600 shows a message prompting the operator to enter print conditions on a display panel (step S2). Then, the CPU 600 judges whether all of the print conditions, such as the thickness and size of the printing sheet and the number of prints, have been entered (step S3). If the CPU 600 judges that there is any print condition unentered yet, the CPU 600 shows an on-screen message indicating that there is left a print condition to be still entered (step S4).

If the CPU 600 judges that all of the print conditions have been entered in step S3, the CPU 600 then judges whether the image transfer device 6 is currently located at the home position P1 (step S5) If the CPU 600 judges that the image transfer device 6 is not at the home position P1, the CPU 600 actuates the pinion gear 69 to bring the image transfer device 6 back to the home position P1 (step S6).

If the CPU 600 judges that the image transfer device 6 is currently at the home position P1 in step S5, the control unit 110 judges whether the printing sheet to be used is a thick sheet of paper based on the print conditions entered in step S3 above (step S7). If the printing sheet to be used is judged to be a thick sheet of paper, the CPU 600 causes the image forming apparatus 100 to perform a current print job (step S8). Upon completion of the current print job, the CPU 600 judges whether there is any next print job to be performed (step S9) If it is judged that there exists a next print job in step S9, the CPU 600 return to step S5 above. If it is judged that there exists a next print job in step S9, on the other hand, the CPU 600 repositions the image transfer device 6 at the home position P1 and returns to step S1 (step S10).

If the CPU 600 judges that the printing sheet to be used is not a thick sheet of paper in step S7 above, the CPU 600 judges whether the printing sheet to be used is an ordinary sheet of paper (step S11). If the printing sheet to be used is judged to be an ordinary sheet of paper, the CPU 600 shifts the image transfer device 6 downstream along the sheet transport direction to the aforementioned position P2 (step S12), and causes the image forming apparatus 100 to perform a current print job with the image transfer device 6 located at the position P2 (step S13). Upon completion of the current print job, the CPU 600 judges whether there is any next print job to be performed (step S14). If it is judged that there exists a next print job in step S14, the CPU 600 return to step S5 above. If it is judged that there exists a next print job in step S14, on the other hand, the CPU 600 repositions the image transfer device 6 at the home position P1 and returns to step S1 (step S10).

If the CPU 600 judges that the printing sheet to be used is not a thick sheet of paper in step S7 above, the CPU 600 judges whether the printing sheet to be used is a thin sheet of paper (step S15). If the printing sheet to be used is judged to be a thick sheet of paper, the CPU 600 shifts the image transfer device 6 further downstream along the sheet transport direction to the aforementioned position P3 (step S16), and causes the image forming apparatus 100 to perform a current print job with the image transfer device 6 located at the position P3 (step S17). Upon completion of the current print job, the CPU 600 judges whether there is any next print job to be performed (step S18). If it is judged that there exists a next print job in step S18, the CPU 600 return to step S5 above. If it is judged that there exists a next print job in step S18, on the other hand, the CPU 600 repositions the image transfer device 6 at the home position P1 and returns to step S1 (step S10).

The image transfer device 6 thus structured transfers the toner image from the outer surface of the photosensitive drum 3 onto the printing sheet with the image transfer electrode roller 61 located at one of the different positions along the sheet transport direction according to the properties of the printing sheet, such as the thickness of the printing sheet and the ambient temperature or humidity which is related to the water content of the printing sheet. This arrangement of the aforementioned embodiment makes it possible to create an image transfer electric field having an intensity suited to the properties of the printing sheet despite the fact that a constant voltage is applied to the image transfer electrode roller 61.

Accordingly, the arrangement of the embodiment eliminates the need for the provision of such a component as a variable resistor for controlling the voltage applied from the power supply unit 111 to the image transfer electrode roller 61, so that the embodiment makes it possible to reduce the physical size and manufacturing cost of the image transfer device 6. The arrangement of the embodiment also makes it possible to reduce a load of a power supply control system. Furthermore, since the arrangement of the embodiment serves to protect the photosensitive drum 3 from potentially occurring overcurrent and overvoltage, it is possible to prevent deterioration of the photosensitive drum 3 and provide improved operational safety. Moreover, since the image transfer device 6 performs the image transfer operation under conditions where the image transfer electrode roller 61 is located downstream of the image transfer position T, it is possible to improve the performance of the image transfer device 6 to peel the sheet S off the photosensitive drum 3. Additionally, since the image transfer electrode roller 61 is not located upstream of the image transfer position T, it is possible to prevent dispersing of the toner powder which could occur when the image transfer electrode roller 61 is located upstream of the image transfer position T.

Figure 8A:
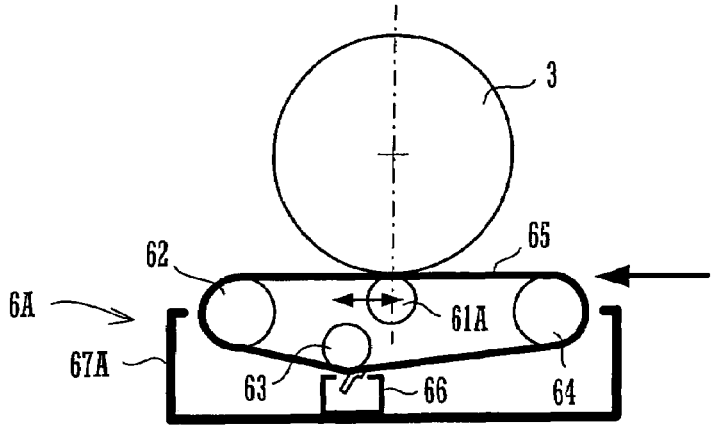
Figure 8B:
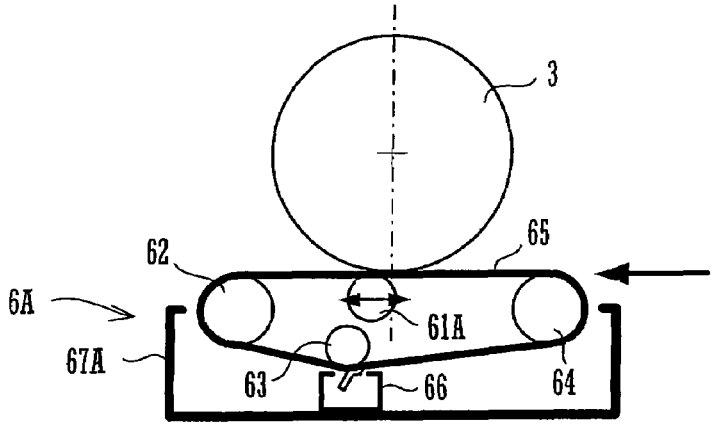
Figure 8C:
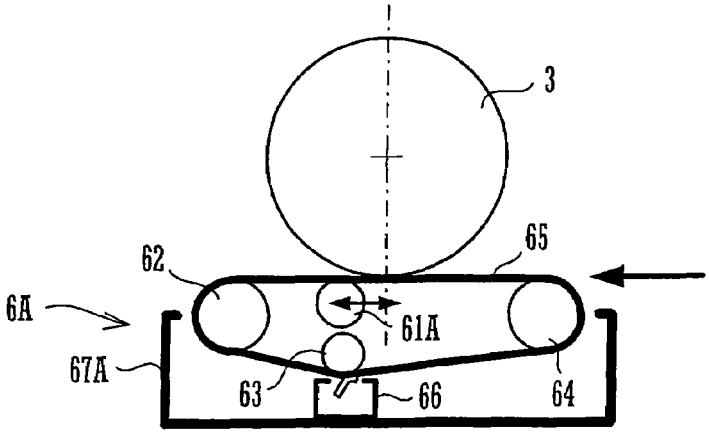

FIGS. 8A, 8B and 8C are diagrams showing how an image transfer device 6A according to a second embodiment of the invention is shifted and where an image transfer electrode roller 61A of the image transfer device 6A is located according to properties of individual printing sheets. Specifically, FIG. 8A shows a position where the image transfer electrode roller 61A is located when the printing sheet in use is a thick sheet of paper or when the result of detection obtained by the ambient condition sensor 606 is high temperature or high humidity, FIG. 8B shows a position where the image transfer electrode roller 61A is located when the printing sheet in use is an ordinary sheet of paper or when the result of detection obtained by the ambient condition sensor 606 is normal temperature or normal humidity, and FIG. 8C shows a position where the image transfer electrode roller 61A is located when the printing sheet in use is a thin sheet of paper or when the result of detection obtained by the ambient condition sensor 606 is low temperature or low humidity.

While the image transfer device 6 is displaced in its entirety to move the image transfer electrode roller 61 in the image transfer device 6 of the first embodiment, only the image transfer electrode roller 61A is moved in the image transfer device 6A of this second embodiment.

In the image transfer device 6A of this embodiment, a pair of pinion gears is fitted to both ends of a rotary shaft of the image transfer electrode roller 61A and a pair of racks which engages with the pinion gears is fitted to side holes made in a frame 67A. With this arrangement, the image transfer electrode roller 61A can be moved to desired positions along the sheet transport direction by turning the image transfer electrode roller 61A.

Like the image transfer device 6 of the first embodiment, the image transfer device 6A of the second embodiment performs the image transfer operation under conditions where the image transfer electrode roller 61A is located more downstream along the sheet transport direction as the printing sheet becomes thinner. Also, the lower the temperature or humidity which is related to the water content of the printing sheet, the more downstream along the sheet transport direction the image transfer electrode roller 61A is located when performing the image transfer operation.

As the image transfer belt 65 is not displaced in the image transfer device 6A of the present embodiment, each printing sheet is fed to a fixed position on the image transfer belt 65. Accordingly, the image transfer belt 65 of this embodiment can receive successively fed printing sheets in a reliable fashion, thereby preventing sheet transport jams.

The image transfer devices 6 and 6A of the foregoing embodiments may be modified such that the respective home positions of the image transfer devices 6 and 6A are set at the positions where the image transfer electrode rollers 61 and 61A are at a distance from the photosensitive drum 3 as shown in FIGS. 3C and 8C, instead at the positions where the image transfer electrode rollers 61 and 61A are closest to the photosensitive drum 3 as shown in FIGS. 3A and 8A. This variation of the embodiments serves to decrease nipping pressure applied by the image transfer electrode rollers 61 and 61A and the photosensitive drum 3 to the image transfer belt 65 and thereby prevent deformation of the image transfer belt 65.

Also, the same advantageous effects are obtained even when the recording medium (printing sheet) in use is a postal card, an overhead projector (OHP) film, or the like. Furthermore, an image transfer charging wire may be employed instead of the aforementioned image transfer electrode rollers 61 and 61A according to the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image transfer device comprising an image transfer member for transferring an image visualized by a developer on an image receiving member onto a recording medium with the aid of an image transfer electric field as the recording medium is passed between the image transfer member and the image receiving member, the image transfer member being located face to face with the image receiving member carrying the visualized image, and means for determining information on the properties of each recording medium passed between said image transfer member and said image receiving member which affect the intensity of an image transfer electric field for the transfer of an image thereto;

wherein the image transfer member is structured in such a manner that the image transfer member is movable back and forth along a transport path of the recording medium, and wherein the image transfer member transfers the image onto the recording medium at an automatically selected one of different positions along the transport path of the recording medium determined according to the information on properties of the recording medium which affect the intensity of the image transfer electric field.

2. The image transfer device according to claim 1, wherein the image transfer member transfers the image onto the recording medium at either a position closest to the image receiving member along the transport path of the recording medium or at any one of positions located downstream of the position closest to the image receiving member.

3. The image transfer device according to claim 1, wherein a constant level of voltage is supplied to the image transfer member regardless of the position of the image transfer member.

4. The image transfer device according to claim 1, wherein the smaller the thickness of the recording medium, the more downstream along the transport path of the recording medium is located the position at which the image transfer member transfers the image onto the recording medium.

5. The image transfer device according to claim 4, wherein the thickness of the recording medium is the thickness thereof specified when a request for transferring the image onto the recording medium is accepted.

6. The image transfer device according to claim 1, wherein the position at which the image transfer member transfers the image onto the recording medium is located further downstream along the transport direction of the recording medium as the value of the lowest of either the ambient temperature or the ambient humidity, which are related to a water content of the recording media, decreases.

7. The image transfer device according to claim 6, wherein said temperature and said humidity are temperature and humidity detected when a request for transferring the image onto the recording medium is accepted.

8. The image transfer device according to claim 1 further comprising an endless belt passing between the image receiving member and the image transfer member, the endless belt having a specific electric resistance, wherein the image transfer member transfers the image onto the recording medium when the recording medium is transported along a primary side of the endless belt facing the image receiving member.

9. The image transfer device according to claim 8, wherein the electric resistance of the endless belt is within a range of $1*10^8$ to $1*10^{13}$ Ω·cm in terms of volume resistivity.

10. The image transfer device according to claim 8, wherein a constant level of voltage is supplied to the image transfer member regardless of the position of the image transfer member.

11. The image transfer device according to claim 8, wherein the image transfer member is a roller-shaped.

12. The image transfer device according to claim 11, wherein the image transfer member is held in a standby state at the position closest to the image receiving member when the image transfer member is not executing any image transfer operation.

13. The image transfer device according to claim 11, wherein the image transfer member is held in a standby state at a position away from the image receiving member when the image transfer member is not executing any image transfer operation.

* * * * *